US009435538B2

(12) United States Patent
Clemen

(10) Patent No.: US 9,435,538 B2
(45) Date of Patent: Sep. 6, 2016

(54) ANNULAR COMBUSTION CHAMBER OF A GAS TURBINE

(71) Applicant: Rolls-Royce Deutschland Ltd & Co KG, Blankenfelde-Mahlow (DE)

(72) Inventor: Carsten Clemen, Mittenwalde (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 850 days.

(21) Appl. No.: 13/746,467

(22) Filed: Jan. 22, 2013

(65) Prior Publication Data

US 2013/0192232 A1 Aug. 1, 2013

(30) Foreign Application Priority Data

Jan. 31, 2012 (DE) ..... 10 2012 001 777

(51) Int. Cl.
*F23R 3/28* (2006.01)
*F23C 5/00* (2006.01)
*F23R 3/50* (2006.01)

(52) U.S. Cl.
CPC . *F23R 3/28* (2013.01); *F23C 5/00* (2013.01); *F23R 3/50* (2013.01)

(58) Field of Classification Search
CPC ..... F23R 3/15; F23R 3/20; F23R 5/00; F23R 3/14; F23R 3/28; F23R 3/34; F23R 3/50; F23C 5/00
USPC ..... 60/737–748, 804
See application file for complete search history.

(56) References Cited

U.S. PATENT DOCUMENTS 3,026,675 A * 3/1962 Vesper ..... F23R 3/10 60/742
3,134,229 A * 5/1964 Johnson ..... F23R 3/04 60/748
3,512,359 A * 5/1970 Pierce ..... F23R 3/14 261/79.1
3,518,037 A * 6/1970 Sneeden ..... F23R 3/20 431/350
5,335,502 A * 8/1994 Roberts, Jr. ..... F23R 3/42 60/752
5,373,694 A * 12/1994 Clark ..... F23D 11/38 60/740
5,983,643 A 11/1999 Kiesow
6,286,300 B1 * 9/2001 Zelina ..... F23R 3/14 60/737
6,360,525 B1 3/2002 Senior et al.
6,568,190 B1 5/2003 Tiemann
6,675,587 B2 * 1/2004 Graves ..... F23R 3/04 60/748
2010/0293953 A1 11/2010 Wilbraham

FOREIGN PATENT DOCUMENTS

DE 19615910 10/1997
DE 102010023816 12/2011
WO 99/56060 11/1999

OTHER PUBLICATIONS

German Search Report dated Sep. 11, 2012 from counterpart application.

*Primary Examiner* — Charles Freay
(74) *Attorney, Agent, or Firm* — Timothy J. Klima; Shuttleworth & Ingersoll, PLC

(57) ABSTRACT

The present invention relates to an annular combustion chamber of a gas turbine with—relative to the engine axis—a radially outer combustion chamber wall and a radially inner combustion chamber wall, with the combustion chamber walls forming an annular combustion space, with a combustion chamber head having a plurality of fuel nozzles and air inlet openings, with the respective central axes of the fuel nozzles forming an envelope rotationally symmetrical to the engine axis, the envelope dividing the combustion chamber into an annular and radially outer area and an annular and radially inner area, with the radially outer area and the radially inner area having the same volumes.

3 Claims, 4 Drawing Sheets

ANNULAR COMBUSTION CHAMBER OF A GAS TURBINE

Figure 1:
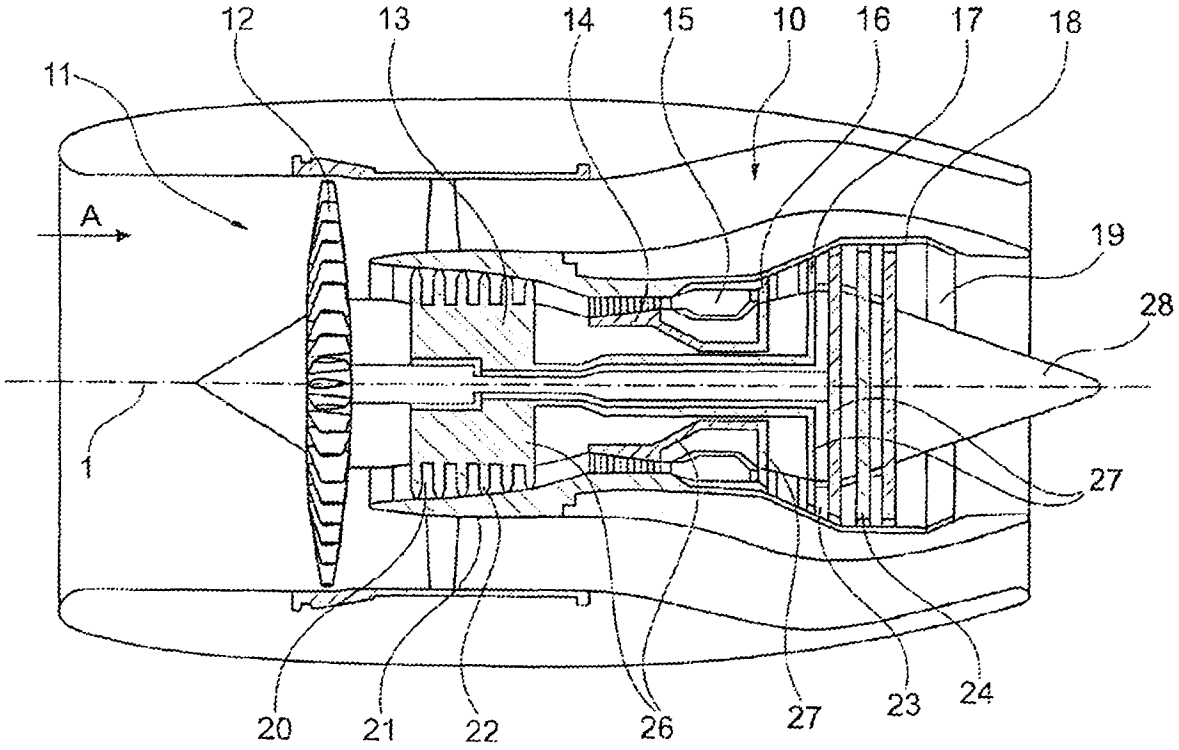

This application claims priority to German Patent Application DE102012001777.4 filed Jan. 31, 2012, the entirety of which is incorporated by reference herein.

This invention relates to an annular combustion chamber of a gas turbine. An annular combustion chamber of this type has an upper/radially outer combustion chamber wall and a lower/radially inner combustion chamber wall that together form an annular duct. Air and fuel are supplied to the combustion chamber by the fuel nozzle, and air is also supplied by cooling or air inlet openings on the side walls. Air and fuel are mixed and combusted in the fuel nozzle and in the combustion chamber respectively. The air and the combustion products are passed through the combustion chamber outlet nozzle in the direction of the turbine.

The existing combustion chamber geometries are disadvantageous in that the geometries have weaknesses in terms of the flow guidance of the air. For example, the side wall geometries and the area cross-sections along the combustion chamber axis are not optimally designed from the aerodynamics viewpoint, with the result that the flow is not routed through the combustion chamber in an optimum manner in terms of losses, and flow separations/boundary layer accumulations and wake zones can result close to the combustion chamber walls. This can have a negative effect on the mixing of air and fuel and hence also on flame formation, flame stability and fuel combustion, with the result that emissions of the combustion chamber can be negatively influenced.

The object underlying the present invention is to provide a gas turbine annular combustion chamber of the type specified at the beginning which, while being simply designed and easily and cost-effectively producible, avoids the disadvantages of the state of the art and is characterized by good flow conditions and a high efficiency.

The annular combustion chamber in accordance with the invention is therefore designed such that the respective central axes of the fuel nozzles form an envelope which is rotationally symmetrical to the engine axis and which divides the combustion chamber into an annular and radially outer area and an annular and radially inner area, with the radially outer area and the radially inner area having the same volumes.

The solution in accordance with the invention thus provides an annular combustion chamber in which the air/fuel flows are evenly distributed in the radial direction. Since the central axes of the fuel nozzles for the respective flows leaving the fuel nozzles form a central axis or symmetry axis, these flows are now symmetrically structured in particular in the radial direction. They are not affected by unsuitable combustion chamber wall geometries. It is thus possible to achieve largely undisrupted flow conditions and hence undisrupted combustion conditions, which in turn lead to improved operating conditions. The result in accordance with the invention is a better mixing of fuel and air, air guidance with lower losses inside the combustion chamber, better cooling efficiency, better flame stability, better burn-out and lower emissions.

The present invention thus provides that the design of the side wall geometry is based on the provision of a symmetrical annular combustion chamber which has identical areas relative to the axis of the fuel nozzle.

The following is therefore provided in accordance with the invention:

The combustion chamber has a freely selectable length L.

The coordinate in the horizontal direction is x (in the following referred to as combustion chamber axis).

As a function of the length L any area curve A(x) can be preset.

At the inlet of the combustion chamber, the fuel nozzle is located at x=0, whose center point (axis) is located on a freely selectable radius $R_1$.

The axis of the fuel nozzle can be either horizontal, i.e. parallel to the engine or combustion chamber axis, or inclined relative thereto at a freely selectable angle $\alpha$.

If the axis of the fuel nozzle is extended from x=0 to L (L=length of combustion chamber), the result precisely in the combustion chamber outlet is a radial end point $R_2(L)$ obtained from the angle of the axis inclination $\alpha$, the combustion chamber length L and the radius $R_1$ of the axis starting point (center point of fuel nozzle at L=0) with $R_2(L)=R_1+L\cdot\tan\alpha$. The line thus obtained is referred to hereinafter as the combustion chamber centerline M. With the equation, it is then possible to determine, at every other axial position x between the combustion chamber inlet at x=0 and the combustion chamber outlet at x=L, the radius R(x) of the combustion chamber centerline M with $R(x)=R_1+x\cdot\tan\alpha$.

Based on this combustion chamber centerline M, the geometry of the outer and inner combustion chamber walls can now be defined.

To do so, any cross-sectional area curve A(x) along the combustion chamber length L is preset.

In accordance with the invention, there is now at every point along the combustion chamber centerline M precisely one half of the area defined for this position above (radially outside) the combustion chamber centerline M, while the other half is underneath (radially inside) the combustion chamber centerline M.

With these requirements, the coordinates (axial position and radial position) of the inner and outer combustion chamber walls can be determined.

Determination of the inner combustion chamber wall for any position x along the combustion chamber axis between x=0 (combustion chamber inlet, position of fuel nozzle) and x=L (combustion chamber outlet):

Radius $R_1$:

the area A(x) and the radius R(x) of the combustion chamber centerline M are given, $$\text{then } R_1(x) = \sqrt{R(x)^2 - \frac{0.5 \cdot A(x)}{\pi}}$$

Axial position $X_i$:

$R_1(x)$, R(x), x and a are given, $$\text{then } X_1(x)=x-(R_1(x)-R(x))\cdot\tan(\alpha)$$

Determination of the outer combustion chamber wall for any position x along the combustion chamber axis between x=0 (combustion chamber inlet, position of fuel nozzle) and x=L (combustion chamber outlet):

Radius $R_A$:

the area A(x) and the radius R(x) of the combustion chamber centerline M are given, $$\text{then } R_A(x) = \sqrt{R(x)^2 + \frac{0.5 \cdot A(x)}{\pi}}$$

Axial position $X_A$:

$R_A(x)$, $R(x)$, x and $\alpha$ are given, then $X_A(x)=x-(R_A(x)-R(x))\cdot\tan(\alpha)$ As mentioned, the combustion chamber centerline M can be arranged at an angle $\alpha$ relative to the engine axis, but it is also possible to align it parallel to the engine axis.

Figure 2:
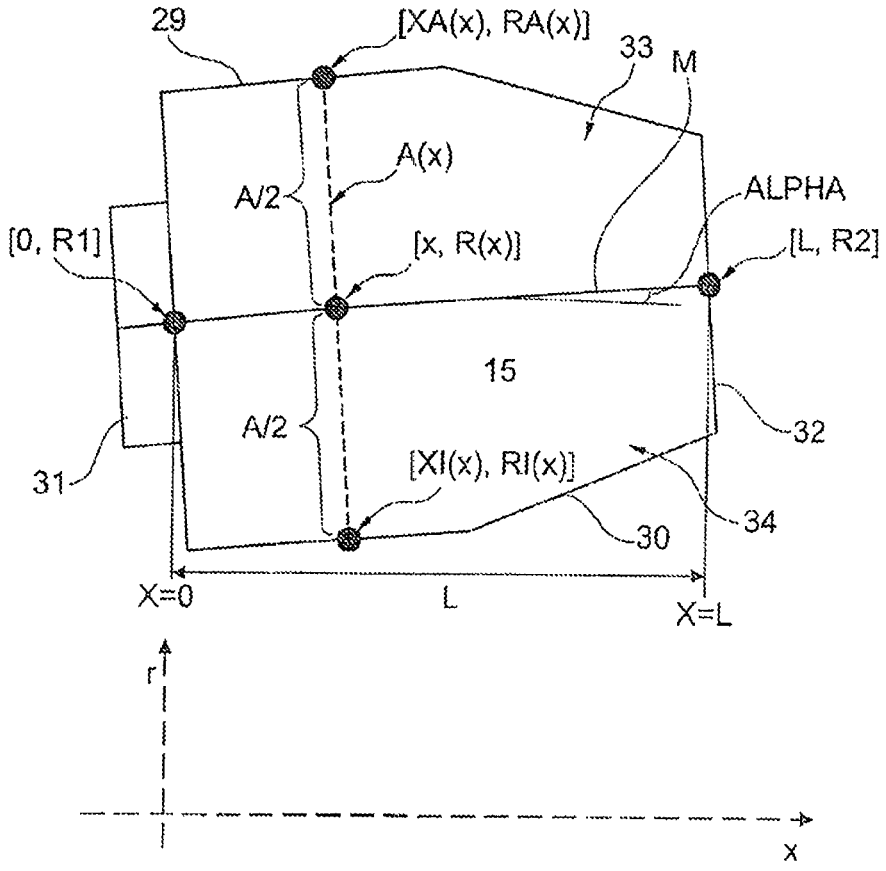
Figure 3:
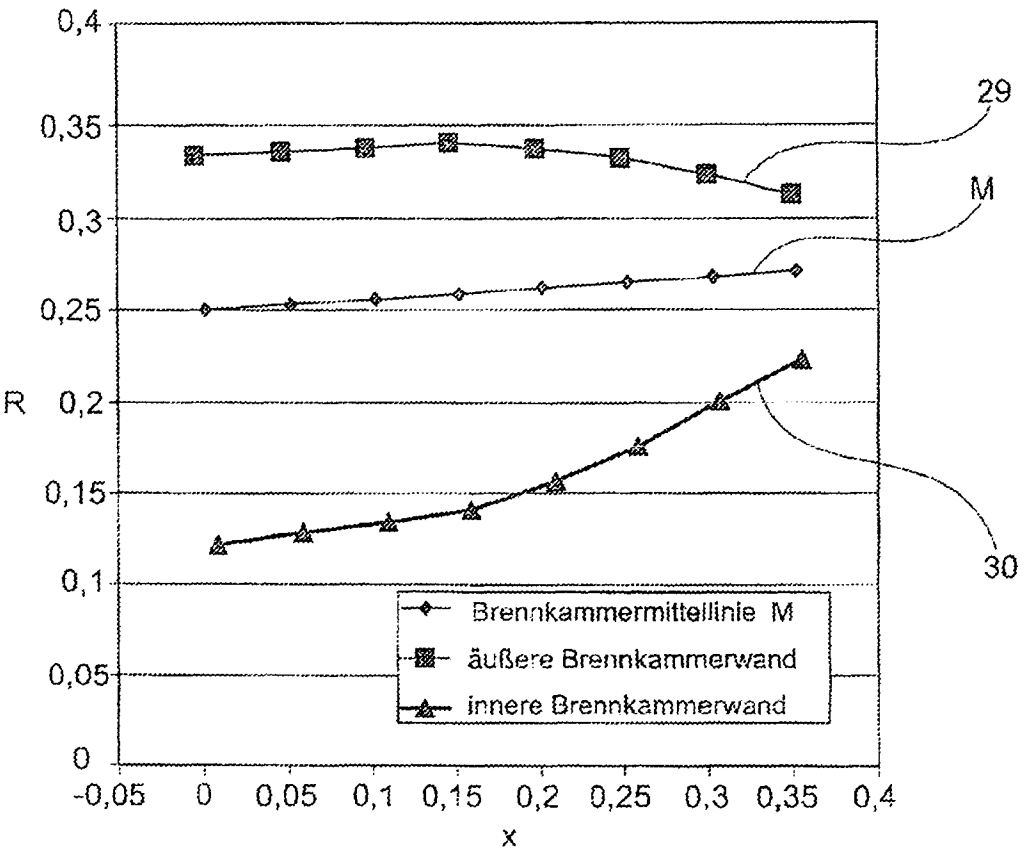
Figure 4:
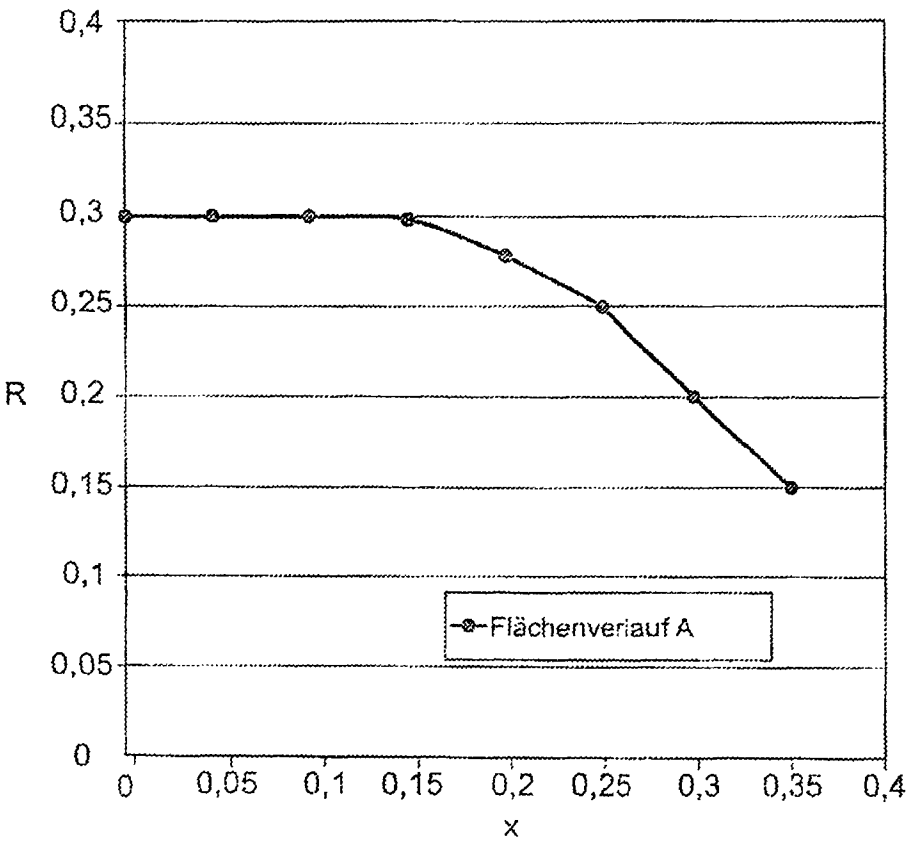

The present invention is described in the following in light of the accompanying drawing, showing an exemplary embodiment. In the drawing, FIG. 1 shows a schematic representation of a gas-turbine engine in accordance with the present invention, FIG. 2 shows a schematic side view of an annular combustion chamber in accordance with the present invention with definition of the sizes used, FIG. 3 shows a schematic representation of the radii resulting from the invention of the outer combustion chamber wall and of the inner combustion chamber wall as a function of the length of the combustion chamber, and FIG. 4 shows a curve of the cross-sectional area of the exemplary embodiment shown in FIG. 3 as a function of the length of the combustion chamber.

The gas-turbine engine 10 in accordance with FIG. 1 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, an annular combustion chamber 15 (with fuel nozzle 31 and combustion chamber outlet nozzle 32 as well as outer combustion chamber wall 29 and inner combustion chamber wall 30, refer to FIG. 2), a high-pressure turbine 16, an intermediate-pressure turbine 17 and a low-pressure turbine 18 as well as an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

FIG. 2 shows in schematic representation a definition of the sizes used. The X axis (abscissa) is identical to the engine axis 1, the ordinate shows the radius relative to the engine axis 1. The illustration in FIG. 2 shows the assignment described above of the individual sizes. In particular, the result is that the cross-sectional area A is defined relative to a plane (shown by the dashed line in FIG. 2) vertical to the combustion chamber centerline M. The individual combustion chamber centerlines M thus define a frustum-shaped envelope rotationally symmetrical to the abscissa X or the engine axis 1, respectively, and which divides the combustion chamber into an annular radially outer region 33 and the annular radially inner region 34, with the annular radially outer region 33 and the annular radially inner region 34 having the same volumes. Since the combustion chamber centerlines M are inclined relative to the engine axis 1 by the angle $\alpha$, the result for consideration of the cross-sectional areas is thus also a cone envelope rotationally symmetrical about the engine axis 1.

FIGS. 3 and 4 show individually computed values for designing the cross-sectional profile, shown in simplified form, of the annular combustion chamber 15 with the radially outer combustion chamber wall 29 and the radially inner combustion chamber wall 30. Furthermore, the straight-lined combustion chamber centerline M is shown. With reference to the illustration in FIG. 2, the result is identical regions radially outside and radially inside the combustion chamber centerline M. Hence a uniform flow through the annular combustion chamber 15 is possible, from the fuel nozzle 31 to the combustion chamber outlet nozzle 32.

The length L of the annular combustion chamber results from structural and design requirements, in particular with regard to the necessary flow length and to the flame geometry and ignitability. The respectively necessary areas A are obtained by way of analogy from the design and physical requirements.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Annular combustion chamber
16 High-pressure turbine
17 Intermediate-pressure turbine
18 Low-pressure turbine
19 Exhaust nozzle
20 Guide vanes
21 Engine casing
22 Compressor rotor blades
23 Stator vanes
24 Turbine blades
26 Compressor drum or disk
27 Turbine rotor hub
28 Exhaust cone
29 Outer combustion chamber wall
30 Inner combustion chamber wall
31 Fuel nozzle
32 Combustion chamber outlet nozzle
33 Annular radially outer region
34 Annular radially inner region

What is claimed is:

1. An annular combustion chamber of a gas turbine, comprising:

a radially outer combustion chamber wall relative to an engine axis;

a radially inner combustion chamber wall;

an annular combustion space formed between the radially inner and outer combustion chamber walls;

a combustion chamber head including a plurality of fuel nozzles and air inlet openings, with respective central axes of the fuel nozzles forming an envelope rotationally symmetrical to the engine axis, the envelope dividing the combustion chamber into an annular radially outer region and an annular radially inner region, with the annular radially outer region and the annular radially inner region being equal in volume;

wherein, at each position along envelop in an axial direction of the gas turbine, a respective conical section around the combustion chamber is defined, with the respective conical section being centered on the engine axis and perpendicular to each of the central axes of the fuel nozzles, with the annular radially outer region and the annular radially inner region being equal in area in each respective conical section.

2. The annular combustion chamber of a gas turbine in accordance with claim 1, wherein the respective central axes of the fuel nozzles are inclined relative to the engine axis by an angle.

3. The annular combustion chamber of a gas turbine in accordance with claim 2, wherein radii of the radially outer and inner combustion chamber walls are defined as follows:

radius of radially inner combustion chamber wall relative to the engine axis at position X along the engine axis:

$$R_1(x) = \sqrt{R(x)^2 - \frac{0.5 \cdot A(x)}{\pi}}$$

radius of radially outer combustion chamber wall relative to the engine axis at position X along the engine axis:

$$R_A(x) = \sqrt{R(x)^2 + \frac{0.5 \cdot A(x)}{\pi}}$$

with:

L=length of the combustion chamber,

X=position along the engine axis, where X=0 at a combustion chamber inlet of the fuel nozzle and X=L at a combustion chamber outlet, R(x)=radius of a combustion chamber centerline relative to the engine axis at position X along the engine axis, A(x)=cross-sectional area of the combustion chamber relative to the combustion chamber centerline at position X on the combustion chamber centerline, $\alpha$=inclination angle of the respective central axes of the fuel nozzles relative to the engine axis, and with $$X_1(x)=x-(R_1(x)-R(x))\cdot\tan\alpha$$

$$X_A(x)=x-(R_A(x)-R(x))\cdot\tan\alpha.$$

* * * * *